US006860389B2

(12) United States Patent
Kraxner

(10) Patent No.: US 6,860,389 B2
(45) Date of Patent: Mar. 1, 2005

(54) FIXTURE FOR RECYCLING BOTTLES AND RECYCLING BOTTLE

(75) Inventor: Ernest E. Kraxner, Graz (AT)

(73) Assignee: Prof. Birkmayer Gesundheitsprodukte GmbH, Vienna (AT)

( * ) Notice: Subject to any disclaimer, the term of this patent is extended or adjusted under 35 U.S.C. 154(b) by 0 days.

(21) Appl. No.: 10/112,553

(22) Filed: Mar. 29, 2002

(65) Prior Publication Data

US 2002/0175103 A1 Nov. 28, 2002

Related U.S. Application Data

(63) Continuation of application No. PCT/AT02/00034, filed on Jan. 29, 2002.

(30) Foreign Application Priority Data

May 25, 2001 (AT) ..... A 832/2001

(51) Int. Cl.[7] ..... B65D 65/00

(52) U.S. Cl. ..... 206/427; 206/141; 206/203; 206/144; 206/506; 220/519; 220/DIG. 15

(58) Field of Search ..... 206/427, 141, 206/203, 431, 162, 139, 145, 201, 509–518, 821; 220/519, 513–516, DIG. 2, DIG. 15; 294/87.2, 87.1, 86.4; 215/10, 202, 378; D9/456

(56) References Cited

U.S. PATENT DOCUMENTS

| | | | | | |
|---|---|---|---|---|---|
| 2,804,985 | A | * | 9/1957 | Cross et al. | 220/512 |
| 3,405,840 | A | * | 10/1968 | Champlin | 206/196 |
| 4,040,517 | A | * | 8/1977 | Torokvei | 206/144 |
| 4,161,259 | A | * | 7/1979 | Palafox | 220/519 |
| 4,204,617 | A | | 5/1980 | Hirota | |
| 4,928,841 | A | | 5/1990 | Arthurs | |
| 5,038,961 | A | * | 8/1991 | Watanabe et al. | 220/519 |
| 5,188,233 | A | * | 2/1993 | Hammett | 206/427 |
| 5,244,106 | A | * | 9/1993 | Takacs | 215/373 |
| 5,673,792 | A | * | 10/1997 | Aikio | 206/509 |
| 5,826,712 | A | * | 10/1998 | Aikio | 206/203 |
| 6,109,857 | A | * | 8/2000 | Trygg | 414/626 |
| 6,279,770 | B1 | * | 8/2001 | Osbakk et al. | 220/519 |
| 6,325,210 | B1 | * | 12/2001 | Henry, Jr. | 206/427 |

FOREIGN PATENT DOCUMENTS

| | | |
|---|---|---|
| DE | 198 29 427 | 1/2000 |
| EP | 0 306 074 | 3/1989 |
| EP | 0 567 873 | 11/1993 |
| GB | 2 182 304 | 5/1987 |
| WO | WO 97/28061 | 8/1997 |
| WO | WO 99/16680 | 4/1999 |

* cited by examiner

*Primary Examiner*—Jila M. Mohandesi
(74) *Attorney, Agent, or Firm*—Kenyon & Kenyon

(57) ABSTRACT

A fixture for recycling bottles made of plastics, which includes a base plate and means for anchoring the bottles arranged on the upper side of the base plate and engaging in indentations provided on the bottle bottoms, and a recycling bottle made of plastics to be used with such a fixture and including an indentation on its bottle bottom. In order to facilitate handling of the bottles for recycling purposes and to enable the automated determination of possible deposits for the bottles as well as the simple and rapid recyclability of the bottles, it is provided that the anchoring means, in a sense oriented away from the upper side of the base plate, have decreasing cross sections and barb-shaped formations. Thus, the optimum support of the bottles on the fixture is safeguarded. Preferably, the base plate is located within the projection of the bottles onto the base plate.

13 Claims, 3 Drawing Sheets

FIXTURE FOR RECYCLING BOTTLES AND RECYCLING BOTTLE

This is a continuation of International Application PCT/AT02/00034, with an international filing date of Jan. 29, 2002, which is now pending and has not been published under PCT Article 21(2).

BACKGROUND OF THE INVENTION

1. Field of the Invention

The present invention relates to a fixture for recycling bottles made of plastics, which includes a base plate and means for anchoring the bottles arranged on the upper side of the base plate and engaging in indentations provided on the bottle bottoms. The present invention also relates to a recycling bottle made of plastics to be used with such a fixture and including an indentation on its bottle bottom.

2. Description of Related Art

Recycling bottles, in particular those made of polyethylene terephthalate (PET), have been gaining ground over glass bottles because of their low weights. For plastic bottles, deposits are rarely collected these days, and that is why recycling bottles are returned to a limited percentage only. This percentage could not even be substantially raised by means of empty plastic bottle collection containers which were set up in population centers in large quantities. Moreover, empty plastic bottles are not easy to handle because the bottles occupy large volumes and tend to fall over due to their low weights and, therefore, preferably have to be collected in rigid containers prior to being handed in at appropriate collection sites. A volume reduction may, of course, be effected by compressing the bottles, yet it will then be required to put the cap back on the bottle so as to prevent the bottle from re-expanding upon air absorption. This involves an additional manipulation besides that of crushing the bottle, which consumers unfortunately do not accept in most cases, thus putting the bottles to residual waste. In addition, a crushed bottle cannot be introduced in an automated machine to determine its deposit, if any.

Since, on the one hand, the number of plastic bottles is steadily increasing, in particular those made of polyethylene terephthalate (PET), and, on the other hand, it is endeavored to substantially raise the number of recyclable bottles, the trend has been to add to the selling price of a bottle an accordingly high deposit for the return of the bottle. In some states, this measure even has been stipulated by adequate laws. It is to be expected that the number of states adopting this course of action is going to increase.

There has consequently been a growing demand for methods or devices enhancing the handling of empty, recycling, plastic bottles for the purpose of returning the same. In order to enable the determination of a bottle deposit, it is required that a recycling bottle will substantially keep its original shape without being crushed, for instance, to reduce its volume.

To this end, bottle carriers have been developed, which, on the one hand, facilitate the carrying of filled bottles from the retailer to the consumer and, on the other hand, enable the return of the empty bottles for refilling or recycling. German Patent 198 29 427, for instance, describes a bottle carrier comprising a base plate on which several bottles may be placed, which are retained by double fingers embracing the bottle. In addition, a handle may be attached to the base plate to enhance the carrying comfort. For the purpose of recycling or refilling, the bottles must usually be manually removed from the carrier, thus calling for another manipulation. Moreover, the double fingers holding the plastic bottles offer insufficient support to empty plastic bottles. Furthermore, the beverage carrier markedly increases the overall weight on account of its relatively large volume.

This last-mentioned drawback has also existed with other beverage carriers in the prior art, such as, e.g., those from U.S. Pat. No. 4,204,617 or from International Patent Application No. WO 99/16680.

Furthermore, there have been presented fixtures for bottles or the like, which are comprised of a base plate including depressions corresponding to the projection of the bottles or the like to be retained. Such fixtures call for additional measures such as, for instance, subsequent foiling in order to impart sufficient stability on the arrangement. After this, a carrying handle is usually mounted to such a foil. Although fixtures of this type are suitable for the selling of filled bottles or the like, the handling of empty bottles or the like will not be facilitated because of an insufficient support of the empty bottles and because carrying without a carrying handle is inconvenient. Fixtures of this type are described, for instance, in European Patent 0 306 074, or in U.S. Pat. No. 4,928,841 as well as European Patent 0 567 873.

A fixture of the instant type is described in International Patent Application No. WO 97/28061, wherein the base plate comprises means for anchoring the bottles and indentations on its lower side so as to enable the stacking of the fixtures occupied by bottles, one above the other. This type of anchorage, however, offers only a limited support such that, in particular, empty bottles will be supported insufficiently on the base plate.

SUMMARY OF THE INVENTION

It is an object of the present invention to provide a fixture for recycling bottles made of plastics, which ensures the simple handling of empty bottles for return purposes while enabling the possible collection of a deposit. To this end, the fixture is to be suitable for use in automated machines intended, for instance, for the determination of the amount of deposit. In order to be accepted as widely as possible, the fixture is to have as low of a volume and weight as possible and enable as rapid and cost-effective a recycling of the bottles as possible. It goes without saying that the fixture is to be offered and sold together with the filled bottles, and additional packaging steps such as the application of a synthetic foil or the attachment of a handle are to be obviated.

Another object of the present invention is to provide a recycling bottle made of plastics to be used with such a fixture.

BRIEF DESCRIPTION OF THE DRAWINGS

The present invention will be described in greater detail with reference to the following drawings wherein.

DETAILED DESCRIPTION OF THE INVENTION

Figure 1:
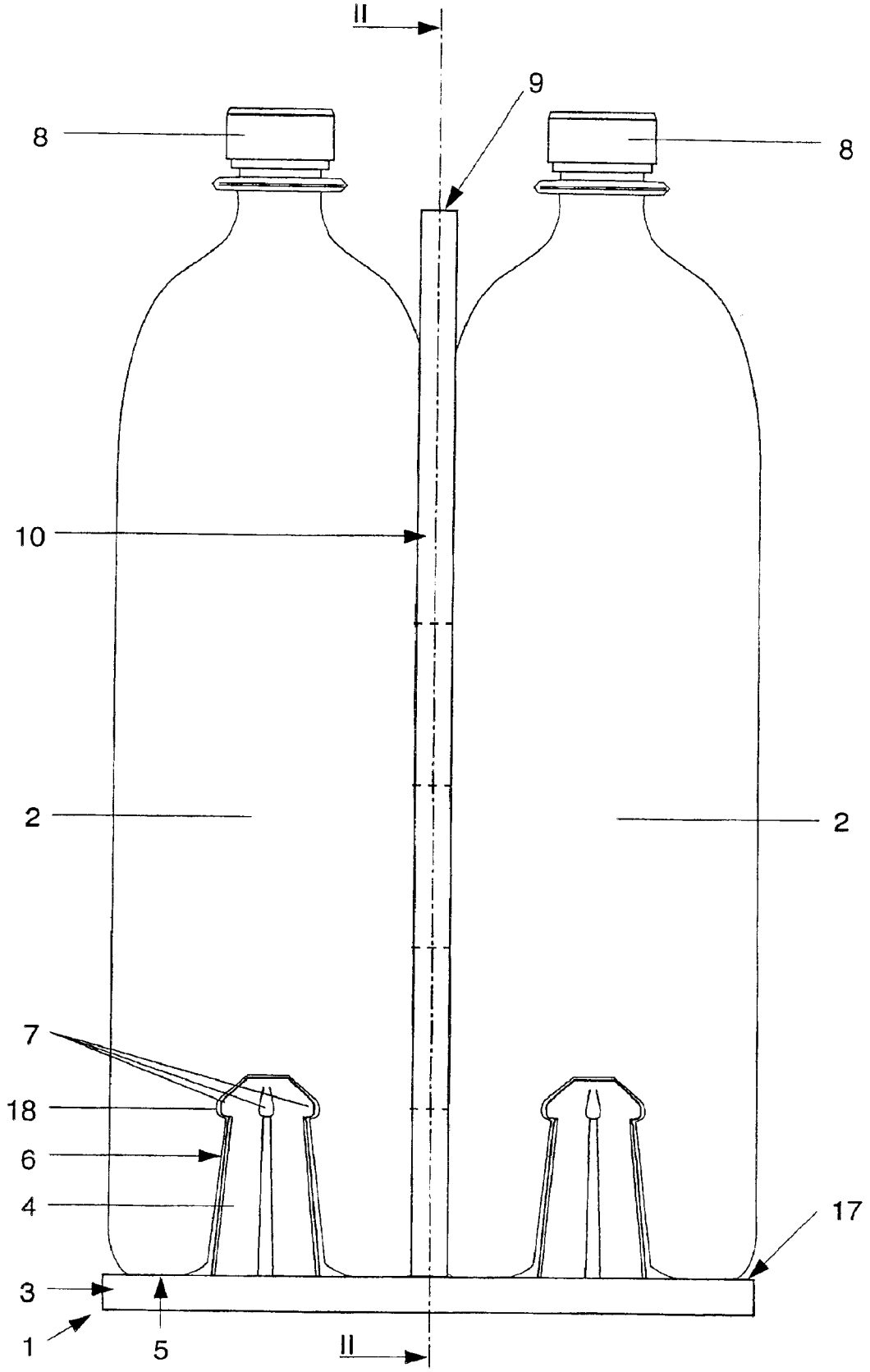
FIG. 1 is a side view of a fixture of the present invention equipped with recycling bottles.

In a fixture of the present invention, the anchoring means, in a sense oriented away from the upper side of the base plate, have decreasing cross sections and barb-shaped formations. Due to the fact that the anchoring means are arranged on the upper side of the base plate, the bottle bottom, which is usually designed to be thicker with recycling bottles made of plastics, is particularly suitable for an anchorage of the bottles on the base plate of the fixture. In addition, such anchoring means are not visible externally and hence will not disturb the optical appearance of the bottle arrangement. The bottles may be readily put on the anchoring means configured according to the present invention, which offer the necessary support of the recycling bottles on the fixture. The compact arrangement of empty bottles within the fixture offers an enhanced qualification for use in automated machines with a view to enabling both the calculation of a possible deposit and recycling. This advantage may be utilized also when filling or labeling bottles, since manipulations are facilitated by the fixture according to the present invention. The means for anchoring the bottles are arranged exclusively on the base plate.

In a preferred embodiment of the present invention, the fixture is made of the same plastics material as the bottles. This ensures the rapid and simple recycling of the bottles together with the fixture. Recycling may, for instance, be effected by disintegrating the bottles together with the fixture and producing granulates to be used again for the production of new bottles and fixtures or even any other products. No additional operating step is required to separate the recycling bottles from the fixture and feed them separately to a recycling process.

If the base plate is arranged within the projection of the bottles on the base plate, no parts of the fixture other than the thickness of the base plate, which might impede handling of the bottles, will project beyond the arrangement of the bottles to be supported. Moreover, no parts projecting from the base plate of the fixture will disturb the optical appearance of the arrangement, which is important in the selling of filled bottles. In addition, the reduced size of the base plate entails a reduced weight of the fixture.

Preferably, the fixture and/or the bottles are made of polyethylene terephthalate (PET), a material very widely used, especially in the beverage industry.

In order to save further weight and volume, the anchoring means may be designed to be star-shaped, as seen from the top view of the base plate. In order to facilitate handling, a carrying handle is provided according to another embodiment of the present invention, wherein the carrying handle is connected to the base plate of the fixture.

In this case, the connection (or connections) of the carrying handle to the base plate of the fixture is preferably arranged between the bottles such that the optical appearance of the bottle arrangement will not be disturbed, and parts likely to cause problems, for instance, in automatic machines, will not project beyond the bottle arrangement.

If the connection (or connections) of the carrying handle to the base plate of the fixture is designed to be elastic and, for instance, includes buckles, then the carrying handle may be lowered in the direction of the base plate during nonuse. This also enables the stacking of the bottles together with their fixture one above the other.

For stacking purposes, the base plate on its lower side includes depressions having dimensions corresponding to the caps of the bottles and arranged to correspond with the arrangement of the bottles on the base plate. Moreover, such depressions further reduce the volume and hence the weight of the fixture.

In order to increase the stability of the fixture, the base plate may comprise reinforcing structures which are, for instance, honeycombed.

In order to reduce the weight of the fixture, the base plate may also include holes.

In a recycling bottle made of plastics of the present invention, the recycling bottle includes locking means in the indentations provided on the bottle bottom. These locking means may be formed by an inwardly increasing cross section of said indentation. Such a construction offers the optimum anchorage of the bottles in the fixture.

FIG. 1 shows a side view of a fixture 1 equipped with recycling bottles 2. The fixture 1 is comprised of a base plate 3 on whose upper side 17 anchoring means 4 are arranged to anchor the bottles 2. For anchorage purposes, the bottles 2 are provided with indentations 6 on the bottle bottoms 5, in which the anchoring means 4 may engage. In order to ensure a good support of the bottles 2 on the fixture 1, the anchoring means 4 comprise barb-shaped formations 7 which engage in corresponding locking means 18 provided on the bottles 2. These locking means 18 are formed by inwardly increasing cross sections of the indentations 6 provided on the bottle bottoms 5. The fixture 1 according to the present invention stands out for its particularly good support of the bottles 2 on the fixture 1 and, in addition, for the fact that the appearance of the arrangement of the bottles 2 is not substantially influenced by the fixture 1. The fixture 1 preferably projects beyond the volume of the arrangement of the bottles 2 merely by the thickness of the base plate 3, which also provides for a low weight of the fixture 1. Since no elements of the fixture 1 project from the outer side of the bottle 2, the fixture 1 may be used, for instance, even during the labeling procedure of the bottles 2. Subsequent foiling of the bottles 2 on the fixture 1 is not required. Thus, the optical appearance of the arrangement of the bottles 2 is not disturbed by the fixture 1. FIG. 1 depicts the bottles 2 with their caps 8 screwed on. Between the rows of bottles 2, a carrying handle 9 may be provided, which is connected to the base plate 3 via at least one connection 10. The connection 10 preferably extends between the bottles 2.

Figure 2:
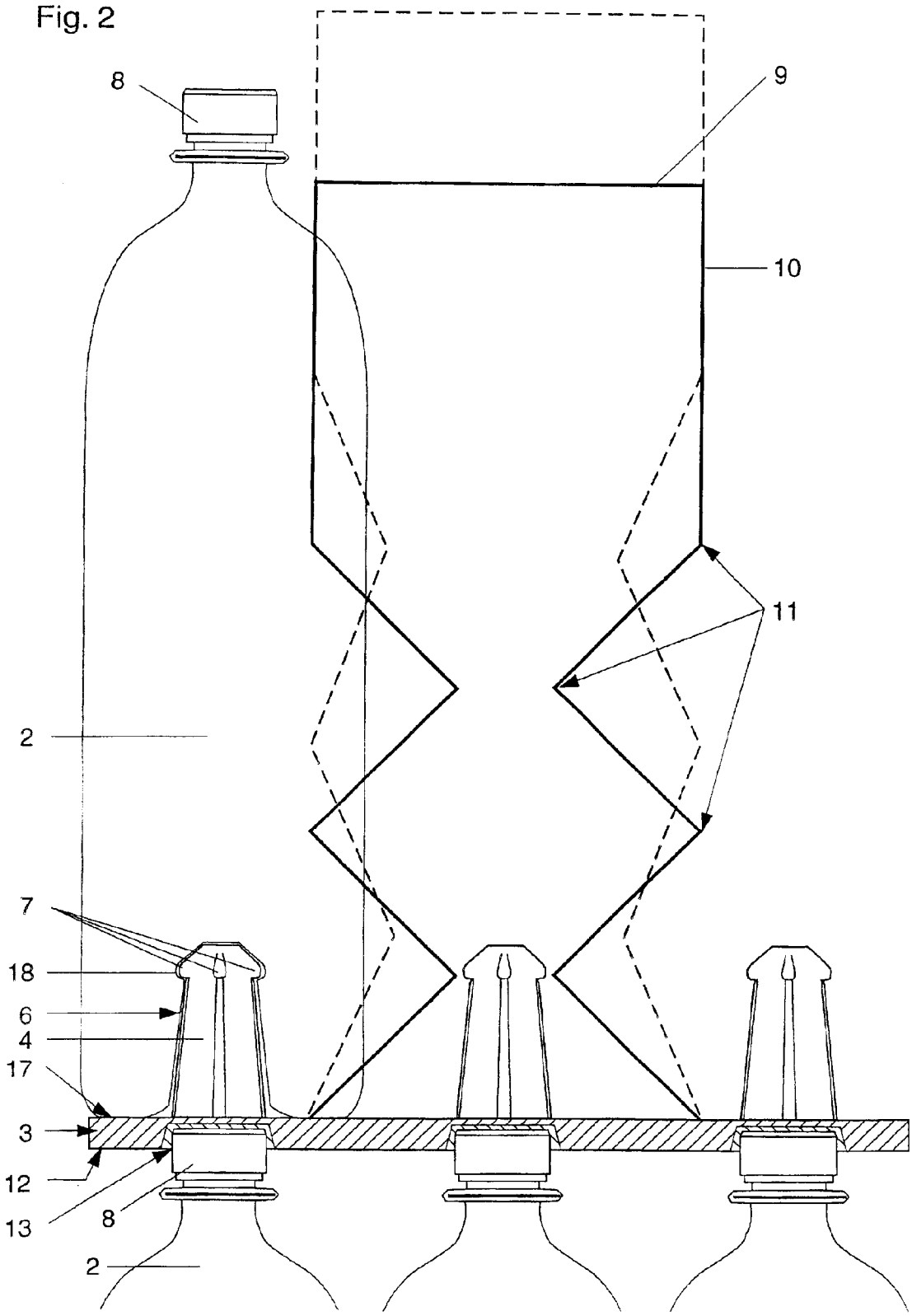
FIG. 2 is a sectional view through the arrangement according to FIG. 1 along sectional line II—II.

FIG. 2 is a sectional view of the fixture 1 with partially anchored bottles 2, along the sectional line II—II of FIG. 1. From this illustration, the carrying handle 9 is more readily apparent. The carrying handle 9 is connected to the base plate 3 via two connections 10. The connections 10 extend between the bottles 2. If the connections 10 are designed to be elastic and, for instance, include buckles 11, it will be feasible to lower the carrying handle 9 in the direction towards the base plate 3 during nonuse, or to cause the same to disappear automatically between the bottles 2 on account of the intrinsic elasticity of the connections 10. In FIG. 2, the carrying handle 9 is entered in broken lines in a slightly extended position. This also renders feasible the stackability of the fixtures 1, which is indicated in FIG. 2. To this end, depressions 13 substantially corresponding to the size of the screw caps 8 of the bottles 2 are provided on the lower side 12 of the base plate 3. In practice, the depressions 13 have larger diameters than the screw caps 8 and, for instance, are designed conically in order to enhance the stackability of the fixture. The arrangement of the depressions 13 on the lower side 12 of the base plate 3 corresponds to the arrangement of the bottles 2 on the base plate 3 so as to enable the stacking of the fixtures 1 together with the bottles 2.

Figure 3:
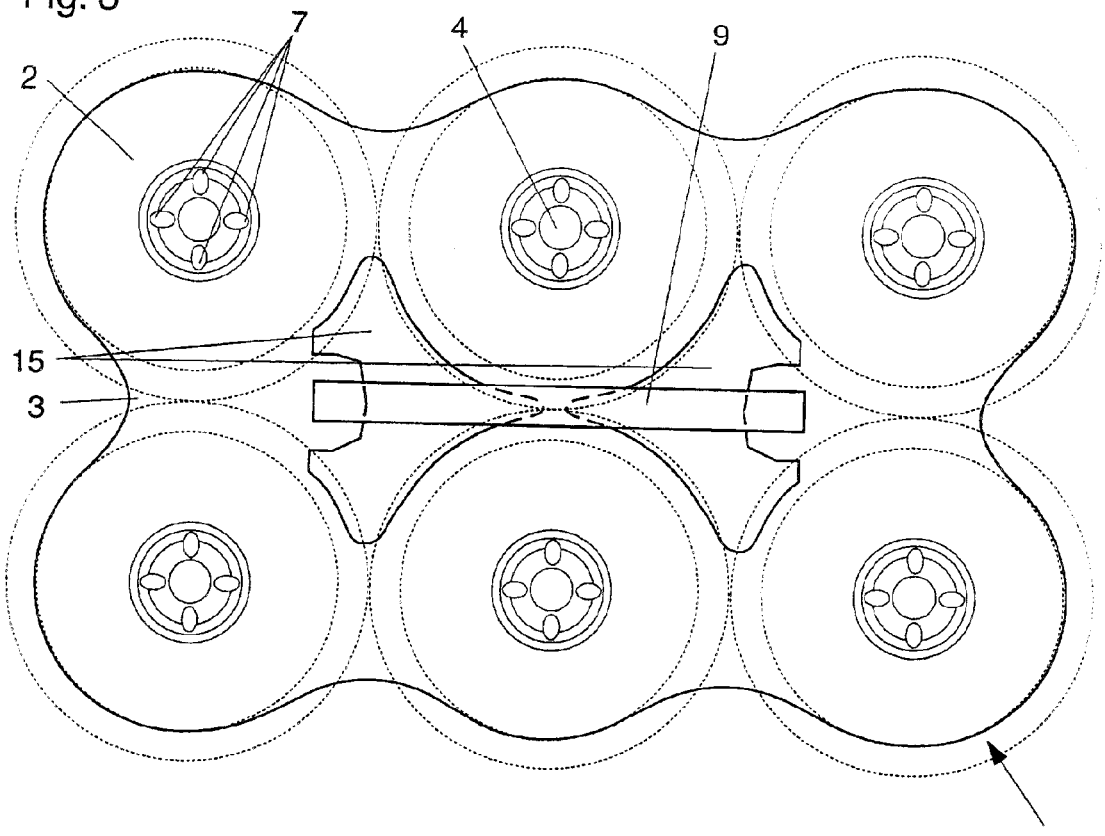
FIG. 3 is a top view of the fixture according to FIGS. 1 and 2.

FIG. 3 is a top view of a fixture 1 with the bottles 2 being entered in broken lines. The anchoring means 4 show the barb-shaped formations 7 in stellar arrangements. Such a stellar arrangement, which may be continued in the anchoring means 4, offers the advantage of a lower weight of the fixture 1. From FIG. 3, the band-shaped carrying handle 9 is also readily apparent.

Figure 4:
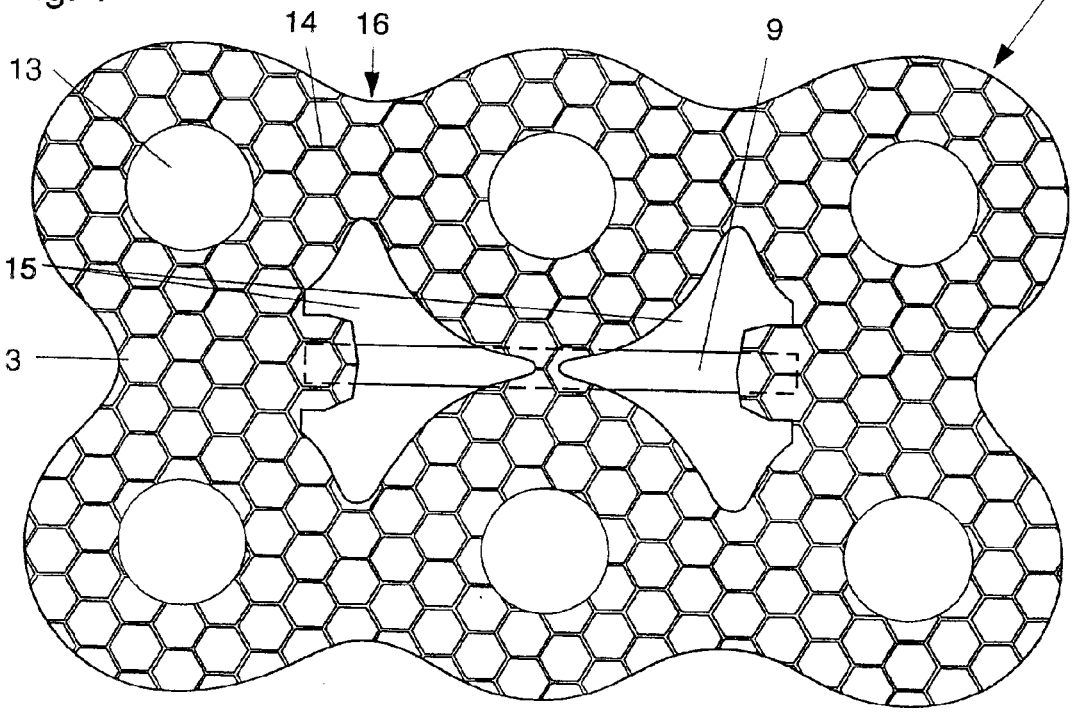
FIG. 4 is a view of the fixture from below.

FIG. 4 shows a view of the base plate 3 of the fixture 1 from below, including the optionally provided depressions 13 to receive the caps 8 of the bottles 2 during stacking. Reinforcing structures 14 may be provided, for instance, in the form of honeycombs to reinforce the base plate 3. The base plate 3 will then have the necessary stability at a low dead weight. In order to further reduce the weight of the fixture 1, the edges of the base plate 3 may comprise indentations 16 or the base plate 3 may be perforated by holes 15.

Although the fixture 1 depicted in FIGS. 1 to 4 is illustrated for six bottles 2, any combination of several recycling bottles 2 is conceivable.

The fixture 1 for recycling bottles according to the present invention renders feasible the optimum handling of the recycling bottles 2 and, in addition, the recycling of the plastic bottles 2 preferably together with the fixture 1, whereby a separation of the bottles 2 from the fixture 1 prior to the recycling process may be obviated, thus saving time and money. The fixture 1 may, of course, have different colors. The anchorage of the bottles 2 on the fixture 1 is configured such that the bottles 2 are sufficiently supported without requiring much force to enable their removal from the fixture.

We claim:

1. A fixture for recycling a plurality of bottles made of plastics, said fixture comprising:

a base plate including an upper side and a lower side; and a plurality of anchoring means on upper side of the base plate for anchoring the plurality of bottles, wherein each of the plurality of anchoring means contains decreasing cross sections and a plurality of barbs, wherein each of the plurality of barbs is connected to the decreasing cross sections only at the smallest cross section of the decreasing cross sections, wherein each of the plurality of barbs horizontally extend beyond the perimeter of the smallest cross section of the decreasing cross sections, and wherein the plurality of anchoring means are configured to engage indentations provided on the bottoms of the plurality of bottles.

2. The fixture of claim 1, wherein the fixture comprises a plastics material, and the plurality of bottles comprises the same plastics material.

3. The fixture of claim 1, wherein the perimeter of the base plate is shaped such that when the plurality of bottles are anchored onto the plurality of anchoring means, the perimeter of the base plate is substantially located within a projection of the plurality of bottles onto the upper side of the base plate.

4. The fixture of claim 1, wherein at least one of the fixture and the plurality of bottles is made of polyethylene terephthalate (PET).

5. The fixture of claim 1, wherein each of the plurality of barbs is located 90 degrees apart from each other on each of the plurality of anchoring means.

6. The fixture of claim 1, further comprising a carrying handle connected to the base plate.

7. The fixture of claim 6, further comprising a connection means connecting the carrying handle to the base plate, wherein the connection means are arranged between at least two bottles of the plurality of bottles.

8. The fixture of claim 6, further comprising a connection means connecting the carrying handle to the base plate, wherein the connection means are elastic.

9. The fixture of claim 8, wherein the connection means include buckles which enable the carrying handle to be lowered in the direction of the base plate during nonuse.

10. The fixture of claim 1, wherein each one of the plurality of bottles includes a cap, and wherein the lower side of the base plate includes a plurality of depressions wherein each one of the plurality of depressions has dimensions corresponding to the caps of the plurality of bottles.

11. The fixture of claim 1, wherein the base plate further includes a reinforcing structure.

12. The fixture of claim 11, wherein the reinforcing structure is in the shape of a honeycomb.

13. The fixture of claim 1, wherein the base plate further includes a plurality of holes.

* * * * *